US009439476B2

(12) United States Patent
Riccardi

(10) Patent No.: US 9,439,476 B2
(45) Date of Patent: Sep. 13, 2016

(54) DECORATIVE ORNAMENT

(71) Applicant: Judith Ann Riccardi, Little Egg Harbor, NJ (US)

(72) Inventor: Judith Ann Riccardi, Little Egg Harbor, NJ (US)

( * ) Notice: Subject to any disclaimer, the term of this patent is extended or adjusted under 35 U.S.C. 154(b) by 226 days.

(21) Appl. No.: 14/311,522

(22) Filed: Jun. 23, 2014

(65) Prior Publication Data

US 2015/0366294 A1 Dec. 24, 2015

(51) Int. Cl.
*A43B 23/24* (2006.01)
*A44C 25/00* (2006.01)

(52) U.S. Cl.
CPC ..... *A43B 23/24* (2013.01); *A44C 25/007* (2013.01)

(58) Field of Classification Search
CPC ..... A43B 23/24; A44C 25/007; A44C 1/00; A44C 7/006; A44C 3/001; A45D 8/24; Y10T 24/1394
USPC ..... 36/136; 63/7
See application file for complete search history.

(56) References Cited

U.S. PATENT DOCUMENTS 322,789 A * 7/1885 Chapman ..... A44B 11/12 24/191
402,315 A * 4/1889 Ennes ..... A61C 5/122 24/490
836,838 A * 11/1906 Shay ..... A41F 11/02 24/489
1,068,837 A * 7/1913 Barnes ..... A41F 11/04 24/490
1,348,102 A * 7/1920 Freyholtz ..... D06F 55/00 24/489
1,386,424 A * 8/1921 Reiter ..... A41B 3/08 24/485
1,422,658 A * 7/1922 Brooks ..... A44B 6/00 24/354
1,738,605 A * 12/1929 Myers ..... A43B 3/0078 2/245
1,779,868 A * 10/1930 Aiken ..... A44B 6/00 24/56
1,784,482 A * 12/1930 Crawford ..... A41F 15/02 24/299
1,822,595 A * 9/1931 Lancor ..... A44B 99/00 132/278
1,985,835 A * 12/1934 Prestinari ..... A44C 5/246 24/71 J
1,995,226 A * 3/1935 Reilly ..... A44B 6/00 24/116 A
2,002,487 A * 5/1935 Beskow ..... A45D 2/2421 132/255
2,030,756 A * 2/1936 Mix ..... A44B 6/00 24/299

(Continued)

*Primary Examiner* — Clinton T Ostrup
*Assistant Examiner* — Anne Kozak
(74) *Attorney, Agent, or Firm* — Stuart M. Goldstein

(57) ABSTRACT

A decorative ornament has a disc shaped plate member which is configured to fit into the top slit pocket opening of a "penny loafer" type shoe or an accessory with a similar opening. An extendable clasp is secured to the plate member. One or more decorative charms, each having a ring shaped section, are positioned around the crosspiece and extension member of the clasp. The decorative section of the charm hangs down from the clasp and extends over the upper surface of the shoe or accessory.

2 Claims, 5 Drawing Sheets

(56) References Cited

U.S. PATENT DOCUMENTS 2,079,521 A * 5/1937 Mix ..... A44B 6/00 24/66.2
2,106,561 A * 1/1938 Beiter ..... A45D 8/16 132/278
2,117,823 A * 5/1938 Placco ..... A44C 1/00 63/20
2,169,461 A * 8/1939 Darvie ..... A44C 1/00 24/340
2,510,286 A * 6/1950 Johnson ..... A44B 6/00 24/531
2,568,511 A * 9/1951 Ogden ..... A44B 6/00 24/327
2,588,655 A * 3/1952 O'Neill ..... A44C 5/246 24/71 J
2,667,676 A * 2/1954 Sampson ..... A44B 9/14 24/355
2,713,706 A * 7/1955 Biagi ..... A44B 6/00 24/115 H
2,723,429 A * 11/1955 Boots ..... A44B 6/00 24/66.8
2,729,866 A * 1/1956 Weinrib ..... A44B 6/00 24/66.13
2,731,812 A * 1/1956 Sullivan ..... A44C 25/001 40/530
2,813,533 A * 11/1957 Fay ..... A45D 8/26 132/279
3,121,932 A * 2/1964 Grafstein ..... A44B 9/18 24/517
3,590,444 A * 7/1971 Goodman ..... A45D 8/34 132/279
3,609,823 A * 10/1971 Boots ..... A44B 6/00 24/66.2
3,705,591 A * 12/1972 Jennis ..... A45D 8/24 132/279
3,812,603 A * 5/1974 Goodman ..... A43B 5/185 36/127
3,863,299 A * 2/1975 Hocq ..... A44C 5/24 24/71 J
4,219,909 A * 9/1980 Anderson ..... A44B 6/00 24/66.2
D280,447 S * 9/1985 Verducci ..... D28/42
5,496,612 A * 3/1996 Ransbottom ..... A43B 3/0078 2/245
5,526,550 A * 6/1996 Huang ..... A44B 6/00 24/66.2
5,535,531 A * 7/1996 Karabed ..... A43C 7/00 24/714.6
5,649,342 A * 7/1997 D'Andrade ..... A43C 7/005 24/712.2
5,979,019 A * 11/1999 Johnson ..... A44B 11/001 224/269
5,979,085 A * 11/1999 Ross ..... A43B 3/0078 36/1
6,029,319 A * 2/2000 Challender ..... A45F 5/022 24/3.11
6,035,569 A * 3/2000 Nagel ..... A47F 5/0068 40/649
D427,510 S * 7/2000 Gary ..... D26/138
6,085,550 A * 7/2000 Ishida ..... A44C 5/22 24/574.1
6,263,702 B1 * 7/2001 Lo ..... A41F 11/06 24/516
6,470,708 B1 * 10/2002 Green ..... A44C 5/2071 24/116 A
6,553,705 B2 * 4/2003 Geiberger ..... G09F 15/0018 40/647
6,675,611 B2 * 1/2004 Hunter ..... A44C 5/2095 63/1.11
6,799,436 B1 * 10/2004 Minassian ..... A44C 5/2042 24/69 J
7,024,732 B2 * 4/2006 Schell ..... A44B 6/00 24/66.2
7,152,367 B2 * 12/2006 Mastronardi ..... A01G 9/128 24/344
7,328,528 B2 * 2/2008 Caminiti ..... A43B 3/0078 2/244
7,661,208 B2 * 2/2010 McKinney ..... A43B 3/0031 36/112
7,698,836 B2 * 4/2010 Schmelzer ..... A43B 3/0078 24/114.11
8,001,657 B2 * 8/2011 Giordano ..... A44C 5/22 224/176
8,266,769 B2 * 9/2012 Murray ..... A43B 3/0078 24/3.12
8,296,910 B1 * 10/2012 Blair ..... A44C 1/00 24/351
8,881,426 B1 * 11/2014 Elze ..... A43B 23/24 36/11.5
8,966,716 B1 * 3/2015 Mortimer ..... A44B 6/00 24/56
9,173,446 B2 * 11/2015 Wreede ..... A43B 3/126
9,210,959 B1 * 12/2015 Jankowski ..... A43B 3/16
9,210,980 B2 * 12/2015 Kowalski ..... A45D 8/26
2007/0084019 A1 * 4/2007 Wilcox ..... A43B 3/0078 24/3.1
2008/0245106 A1 * 10/2008 Imai ..... A44B 17/0047 63/23
2009/0277052 A1 * 11/2009 Chang ..... G09F 3/14 40/1.6
2009/0300948 A1 * 12/2009 Nordstrom-Wehner A43B 23/24 36/136
2010/0011623 A1 * 1/2010 Seckler ..... A43B 1/0054 36/136
2010/0058619 A1 * 3/2010 Ferrante ..... A43B 23/25 36/136
2010/0180472 A1 * 7/2010 Barras ..... A43B 3/0078 36/136
2011/0041363 A1 * 2/2011 Stanfield ..... A43B 1/0054 36/136
2011/0099775 A1 * 5/2011 Chou ..... H02G 3/26 24/489
2011/0126430 A1 * 6/2011 Wike ..... A43B 23/24 36/136
2011/0225851 A1 * 9/2011 Nelson ..... A43B 1/0054 36/136
2011/0271418 A1 * 11/2011 Crockett-Grabus . A43B 1/0081 2/69
2011/0277276 A1 * 11/2011 Pucci ..... A44B 9/20 24/3.3
2012/0042544 A1 * 2/2012 Leo ..... A43B 23/24 36/136
2012/0110873 A1 * 5/2012 Chen ..... A43B 1/0072 36/136
2012/0174443 A1 * 7/2012 Leo ..... A43B 23/24 36/136
2012/0192460 A1 * 8/2012 Barnhart ..... A43B 23/24 36/136
2012/0192461 A1 * 8/2012 Backus ..... F16B 5/0657 36/136
2012/0222331 A1 * 9/2012 Blunden ..... A43B 23/24 36/102
2012/0263895 A1 * 10/2012 Jeter, Jr. ..... A41D 27/08 428/34.1
2012/0284965 A1 * 11/2012 Plekker ..... A43B 23/24 24/3.12
2012/0285046 A1 * 11/2012 Chapin ..... A43B 3/0078 36/136
2013/0019381 A1 * 1/2013 Lovell ..... A43B 23/24 2/245
2013/0025164 A1 * 1/2013 Euresti ..... A43B 3/0078 36/136
2013/0025165 A1 * 1/2013 Hunter ..... A43B 3/0078 36/136
2013/0086820 A1 * 4/2013 Lura ..... A43B 3/12 36/136
2013/0160490 A1 * 6/2013 Aoki ..... A43B 3/0078 63/23
2013/0173501 A1 * 7/2013 Wrubel ..... G06Q 99/00 705/500
2013/0180136 A1 * 7/2013 Leo ..... A43B 23/24 36/136

(56) References Cited

U.S. PATENT DOCUMENTS

2013/0232734 A1* 9/2013 Schein ..... A43B 3/0078 24/302
2013/0273304 A1* 10/2013 Blue ..... B32B 3/06 428/99
2013/0340286 A1* 12/2013 Schindler ..... A43B 3/244 36/101
2014/0000074 A1* 1/2014 Guthner ..... A43C 7/00 24/712.9
2014/0026375 A1* 1/2014 Gibby ..... A45C 13/1069 24/303
2014/0059819 A1* 3/2014 Cleare ..... A43C 7/00 24/712.9
2014/0147618 A1* 5/2014 Schmoll ..... A45F 5/02 428/100
2014/0190207 A1* 7/2014 Marks ..... A44C 15/001 63/1.11
2014/0215859 A1* 8/2014 Leo ..... A43B 23/24 36/136
2014/0250634 A1* 9/2014 Keum ..... A41F 17/00 24/3.12
2015/0128454 A1* 5/2015 Sykes ..... A43B 23/24 36/136
2015/0201708 A1* 7/2015 Maddocks ..... A43B 23/24 36/136
2015/0273672 A1* 10/2015 Barouch ..... B25B 27/00 81/485
2015/0289629 A1* 10/2015 Nakamura ..... A43B 23/24 36/136
2016/0021983 A1* 1/2016 Chapin ..... A44B 1/30 24/453

* cited by examiner

DECORATIVE ORNAMENT

BACKGROUND OF THE INVENTION

There are a vast array of charms, jewelry, and different ornaments which are designed to attach to shoes in order to enhance the decorative nature of footwear. However, these prior shoe ornaments commonly require that the charm or like ornament be attached to cumbersome holders or they are riot securely fastened to the footwear. Many such decorative articles are bulky and protrude into or obtrusively outward from the shoe. None of these prior ornaments are designed for use with shoes having slit pocket openings.

SUMMARY OF THE INVENTION

The decorative ornament of the present invention is particularly configured to be used with footwear having topside slit openings. This type of footwear has its genesis from the "penny loafer", a type of slip-on shoe having a diamond-shaped slit pocket opening on its upper surface, Once worn mostly by men, this style of shoe is now also commonly worn by women who want to make a classic, yet casual fashion statement.

The shoe ornament comprises a thin, disc shaped plate member which fits into the top slit pocket opening of the shoe or an accessory with a similar opening. An extendable clasp is secured to the plate member. One or more decorative charms, each having a ring shaped section, are positioned around the crosspiece and extension member of the clasp. The decorative section of the charm hangs down from the clasp and extends over the upper surface of the shoe or accessory.

The shoe ornament is innovative in its use and function in that it allows easy interchangeability for multitudes of different charms and pendants on all shoes or articles i.e. high heels, belts, wallets, etc. having a small loafer styled slit pocket opening, without the need for any glue, bolts, screws, sewing or cumbersome attachments.

When the disc shaped plate member is combined with its clasp member, it becomes a usable, functional, universal charm and pendant holder, allowing for smooth insertion into any shoe or article that has a slit pocket opening. The wearer can then personally choose whatever charm, pendant or gem she decides to hang from the shoe or accessory. The invention offers the wearer an interchangeable new look with no limitations on any standard sized charm or pendant.

Other types of snaps, pins and adhesives are messy, bulky, do not fit flush/snug to the host or they can mark up, indent, crinkle and/or damage the shoe or article. However, the invention resolves this by fitting flush and snug inside the slit pocket opening, while permitting clean and efficient insertion and removal without leaving any marks or damage.

The clasp side of the decorative ornament would be manufactured so as to allow the clasp to swing open and close with a snug locking fit. This is created by having one side of the clasp with a tightly gripping latch to lock it in place and the other side the ability to swing open and close using a hinge or equivalent element.

Although a straight clasp is the option used for the description herein, the clasp can have a wavy or twirled look, be made with a hook, loop or even have gemstones added onto it for sparkle. It can also be made from most metals or plastics i.e. gold, silver, steel, brass, etc. and can be made longer to hold more than one charm at a time.

The decorative ornament gives the shoe or article a whole new look and style without having to permanently affix a charm onto the article's slit pocket opening itself or having to connect each single charm, one by one, onto separate holders.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
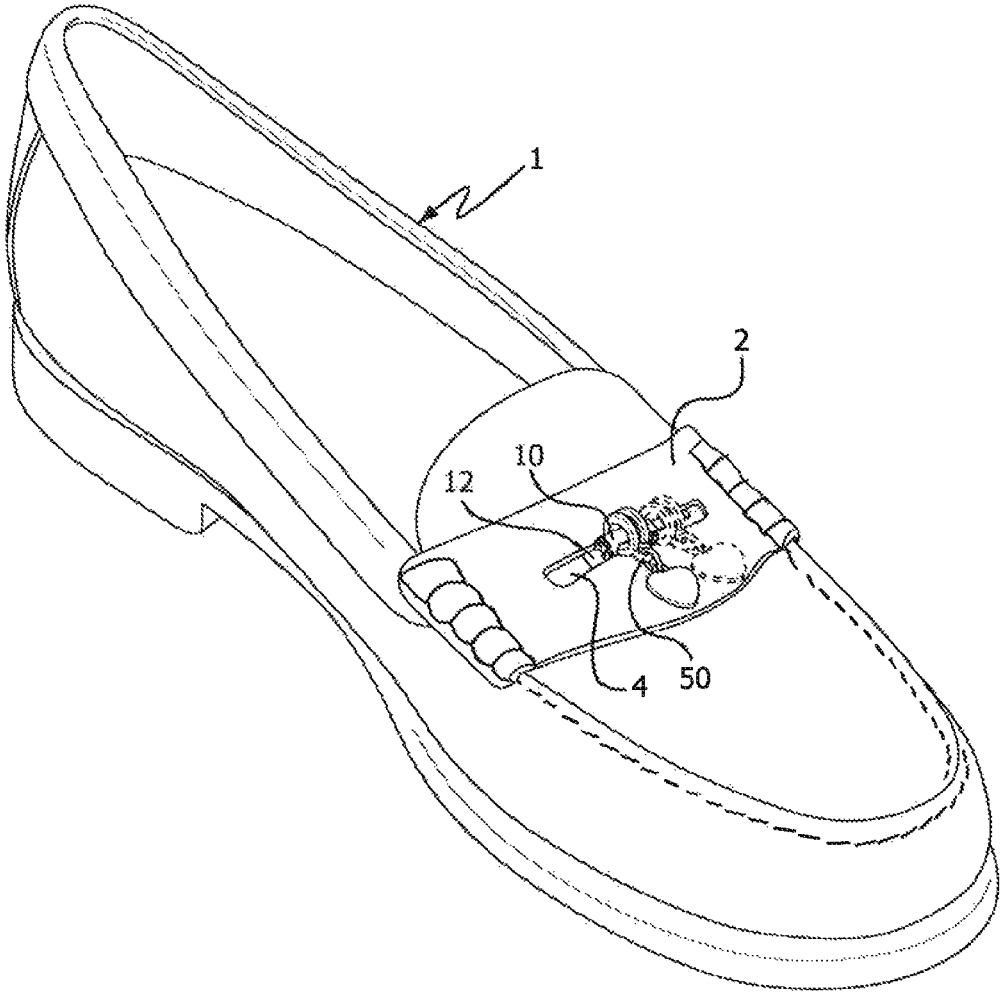
FIG. 1 is a perspective view of the shoe ornament in place, the ornament maintaining decorative charms over the shoe.
Figure 2:
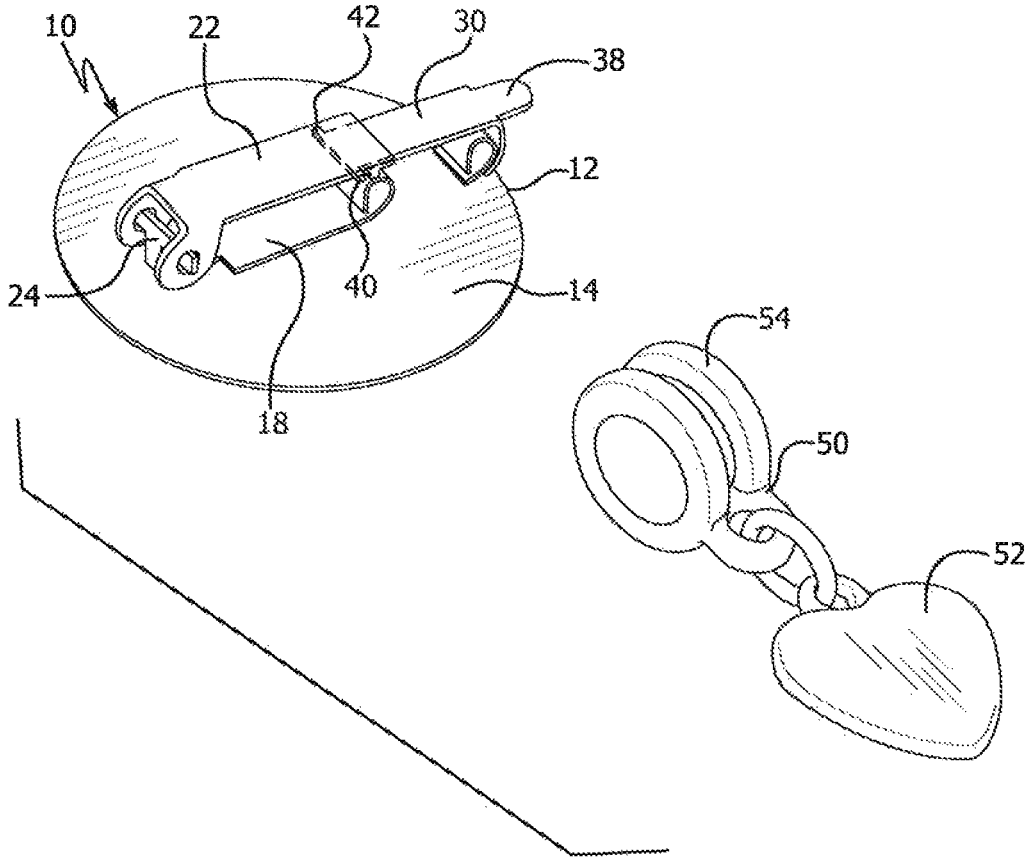
FIG. 2 is an exploded view of the shoe ornament and a decorative charm.

Shoe 1, with upper surface 2, is similar in design to what has come to be known as a "penny loafer." In keeping with this type of design, top slit pocket opening 4 is located through upper surface 2. However, shoe 1 is made decorative by the addition of shoe ornament 10, specifically configured for this type of shoe.

Shoe ornament 10 comprises thin, disc shaped plate member 12 having top surface 14 and bottom surface 16. Clasp base 18, with upstanding end connector section 20, is soldered or otherwise permanently secured to top surface 14 of plate member 12. Clasp crosspiece 22 is rotatably mounted to clasp base 18 by pin 24. In a first or "ornament closed" position, see FIG. 3, crosspiece 22 is maintained adjacent to end connector section 20 of clasp base 18, such that the crosspiece is substantially parallel to the clasp base. In a second or "ornament open" position, see FIG. 5, connector element 26 is lifted off end connector section 20 and crosspiece 22 is rotated back, away from clasp base 18.

Figure 3:
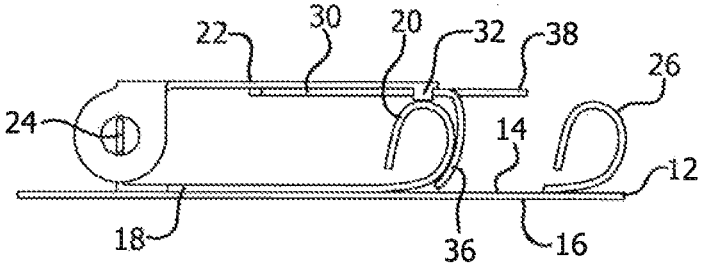
FIG. 3 is an elevation view of the shoe ornament in the closed position, with its extension member in the retracted position.
Figure 4:
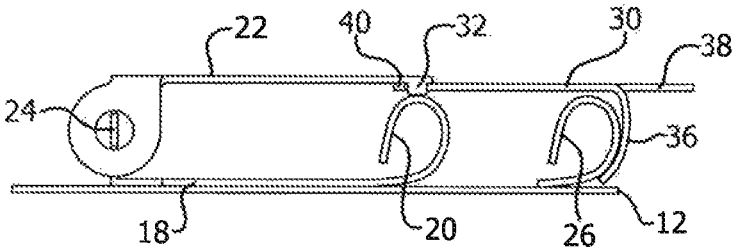
FIG. 4 is an elevation view of the shoe ornament in the closed position, with its extension member in the extended position.
Figure 5:
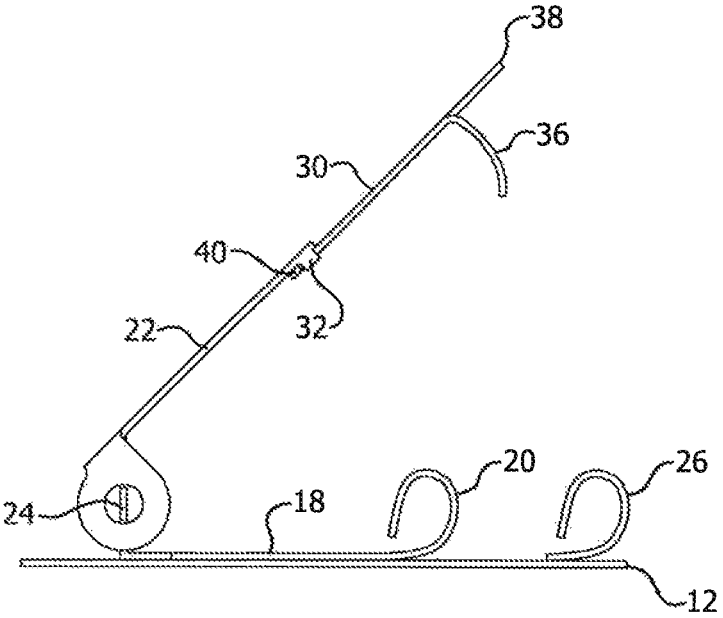
FIG. 5 is an elevation view of the shoe ornament in the open position, with its extension member in the extended position.
Figure 6:
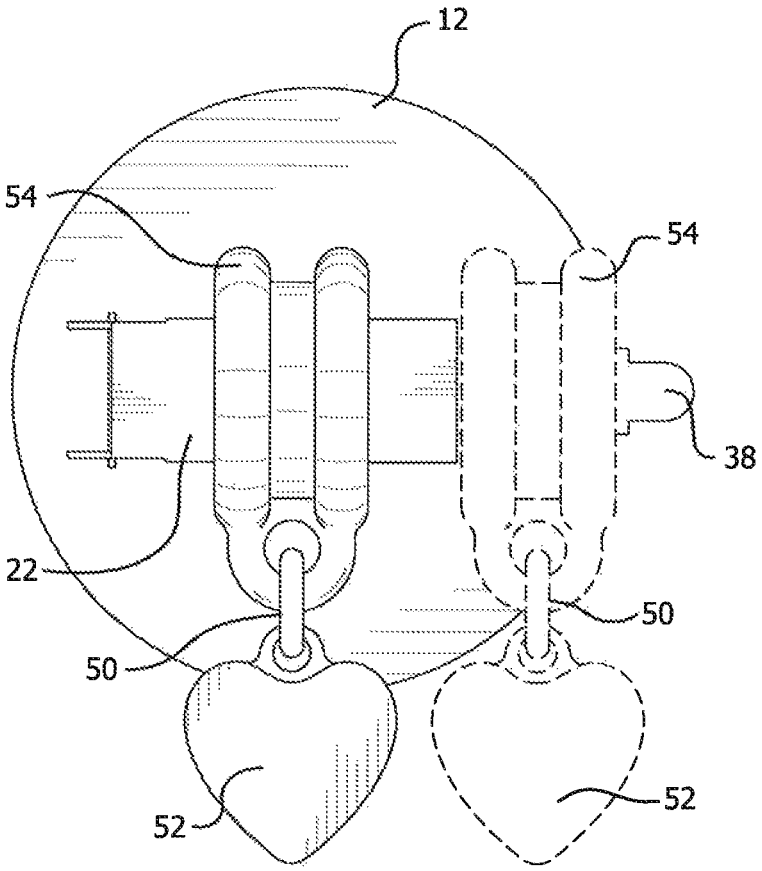
FIG. 6 is a top view of the shoe ornament with a decorative harm in place and further showing the manner in which two charms can be utilized on the ornament.
Figure 7:
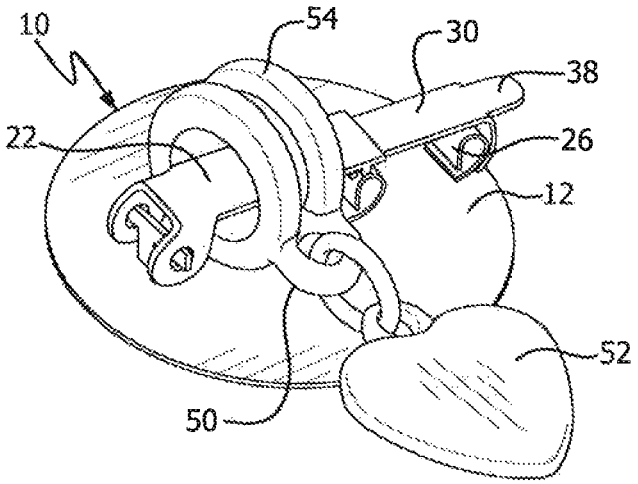
FIG. 7 is a perspective view of the shoe ornament with a decorative charm in place.
Figure 8:
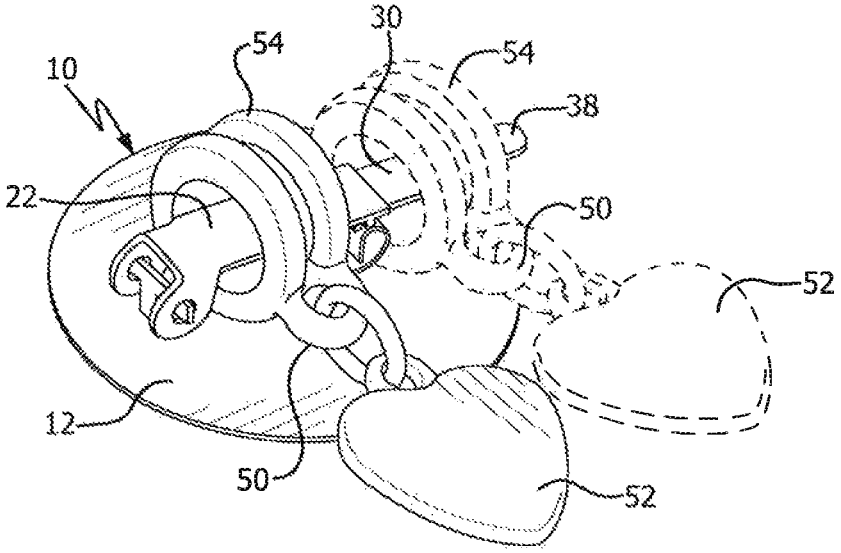
FIG. 8 is a perspective view of the shoe ornament with a decorative charm in place and further showing the manner in which two charms can be utilized on the ornament.

Extension member 30, having end section 36, is slideably mounted beneath crosspiece 22 and is held in place by tabs extending down from the crosspiece. Tab 32 is shown in FIGS. 3-5 and, it can be appreciated that another tab, not shown, extends down from the opposite side of cross-piece 22. In the first, or "ornament closed" position, end section 36 snaps over and rests against end connector section 20 of clasp base 18, see FIG. 3.

Pull tab 38 conveniently allows extension member 30 to be slid out, to the edge of plate member 12. Stopper arms 40 and 42, extending out from extension member 30, contact tab 32 and the opposite side tab on crosspiece 22 to prevent extension member 30 from being separated from the crosspiece. In this extended "ornament closed" position, end section 36 snaps over and rests against upstanding connector element 26 on plate member 12, to assist in maintaining extension member substantially parallel to the clasp base, see FIG. 4.

In use, plate member 12 is inserted into slit pocket opening 4 of shoe 1. Crosspiece 22 is separated from clasp base 18 and placed in the "ornament open" position. In this position, one or more charms 50 can be positioned over shoe 1. Charm 50 has decorative section 52 and ring section 54. One or more of the ring sections 54 of charms 50 are placed around crosspiece 22 and, if extension member 30 is slid outward, over the extension member as well. Crosspiece 22 is then rotated back to the "ornament closed" positions, in which end section 36 snaps over and rests against end connector section 20 in the non-extended "ornament closed" position, and end section 36 snaps over and rests against connector section 26 in the extended "ornament closed" position, to carry charm or charms 50 on the crosspiece and to extend the charms over upper surface 2 of shoe 1.

The type and number of charms 50 can easily be changed by rotating crosspiece 22 away from clasp base 18, removing the charms on the crosspiece and replacing them with different charms with ring sections. This allows users an infinite variety of decorative options for their footwear or other accessories which have a slit pocket opening.

When the user no longer desires to utilize the decorative shoe ornament, plate member 12 is simply removed from slit pocket opening 4.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A shoe having an upper surface comprising:

a slit pocket opening on the upper surface; and a decorative shoe ornament, the shoe ornament comprising:

a disc shaped plate member having a flat top surface, a flat bottom surface, and an upstanding connector element, the plate member being positioned within the slit pocket opening;

a clasp base consisting of a single, flat, straight member having an upstanding connector section, said base being secured directly to the flat top surface of the plate member;

a flat, straight clasp crosspiece rotatably connected to the clasp base for movement between first, second, and third positions;

a flat, straight extension member slideably mounted on the clasp crosspiece, said extension member having an end section being slideable to a position to the edge of the plate member, whereby in the first position the end section of the extension member is secured to the connector section of the clasp base such that the clasp crosspiece is substantially parallel to the clasp base, in the second position the end section of the extension member is secured to the connector element of the plate member such that the clasp crosspiece is substantially parallel to the clasp base, and in the third position the clasp crosspiece is rotated away from the clasp base; and at least one charm having a decorative section and a ring section, said ring section circumscribing the crosspiece or the extension member, said decorative section extending over the upper surface of the shoe.

2. The shoe as in claim 1 further comprising a plurality of charms, each charm having a decorative section and a ring section, said ring sections circumscribing the crosspiece and the extension member, said decorative sections extending over the upper surface of the shoe.

* * * * *